United States Patent [19]

Sereboff

[11] Patent Number: 4,761,011

[45] Date of Patent: Aug. 2, 1988

[54] WATER CUSHION STRESS-REDUCING ASSEMBLIES FOR CHAIRS AND OTHER SEATING DEVICES

[76] Inventor: Joel L. Sereboff, 2215 Millridge Rd., Owings Mills, Md. 21117

[21] Appl. No.: 847,169

[22] Filed: Apr. 2, 1986

[51] Int. Cl.[4] ..... A47C 7/02

[52] U.S. Cl. ..... 297/230; 297/284; 297/396; 297/455; 297/DIG. 3

[58] Field of Search ..... 297/DIG. 3, 230, 231, 297/455, 456, 396, 180, 284

[56] References Cited

U.S. PATENT DOCUMENTS

| | | | |
|---|---|---|---|
| 1,976,320 | 10/1934 | Austin | 297/396 X |
| 2,589,013 | 3/1952 | Martin | 297/396 X |
| 2,867,266 | 1/1959 | Vogler | 297/230 |
| 3,348,880 | 10/1967 | Swann | 297/230 |
| 3,867,732 | 2/1975 | Morrell | 297/DIG. 3 |
| 4,067,078 | 1/1978 | Winston | 297/231 |
| 4,108,492 | 8/1978 | Kirby | 297/DIG. 3 |
| 4,143,909 | 3/1979 | McFarlin | 297/DIG. 3 |
| 4,189,181 | 2/1980 | Noble et al. | 297/DIG. 3 |
| 4,391,466 | 7/1983 | Smith | 297/DIG. 3 |
| 4,547,919 | 10/1985 | Wang | 297/DIG. 3 |

*Primary Examiner*—Francis K. Zugel

*Attorney, Agent, or Firm*—Morton J. Rosenberg

[57] ABSTRACT

A water cushion assembly for a chair, constructed either as an integral assembly or as an attachment, has a plurality of horizontally-arranged vertically-spaced sections; and each of the casings is provided with an inner casing and respective valves for filling the casings with water (or other liquid) to a predetermined level. Each of the sections has a substantially oval cross-section, wherein the external surfaces of the sections are convex, yet are joined together. The front of the chair has a corresponding plurality of horizontally-arranged vertically-spaced scalloped recesses for supporting the respective sections. The assembly is removably secured to the chair by suitable straps provided with "VELCRO" fibrous fasteners (or other suitable means). Water cushion assemblies for the arm rests are also provided.

4 Claims, 6 Drawing Sheets

WATER CUSHION STRESS-REDUCING ASSEMBLIES FOR CHAIRS AND OTHER SEATING DEVICES

FIELD OF THE INVENTION

The present invention relates to fluid cushion assemblies for stress reduction applicable to chairs and other seating devices, such as an executive swivel chair; and more particularly, to a water cushion assembly removably secured to the back of a chair to reduce strain on the occupant's lumbar back region and to alleviate the physical, emotional and psychological stresses associated therewith.

BACKGROUND OF THE INVENTION

The concept of applying the "water bed" techniques to a chair, and especially an office chair of the executive or swivel type, has been generally suggested by the prior researchers; as for example, the respective disclosures in United States Letters Pat. Nos. 3,984,886; 4,143,909, 4,189,181; and 4,391,466.

While the efforts of these earlier researchers are somewhat interesting and should be encouraged, nevertheless their respective solutions leave much to be desired and, to the best of my knowledge and belief, have not met with widespread acceptance in the commercial marketplace. Moreover, these intended solutions appear to "cobbled up", somewhat impractical in production, and in any event not especially tailored to relieve the inherent emotional and psychological stresses associated with the strain placed on the back of the occupant of a chair, even if the chair is of the well-upholstered executive swivel type, and more particularly on the lumbar back region of the occupant.

Indeed, my research in the field of executive stress has indicated that stress of a psychological and emotional nature is often associated with the undue physical stress encountered by an executive who is usually confined to an office chair for eight hours or more per day; and a realization of this condition has apparently eluded the prior researchers to date.

Additionally, those persons suffering from sacroiliac disorders may feel quite uncomfortable due to inadequate support of the thighs. An inadequate support of a person's thighs, either too rigid or too soft, may be translated into inappropriate pressure on the thighs, thereby causing undue stress. Thus, it would be desirable to have the capability of adjusting the degree of pressure on the person's back or on the person's thighs, especially where chronic sacroiliac problems, particularly pressure on the sciatic nerve, are encountered.

My research has also shown that patients recovering from severe burns, as well as stroke victims and those suffering from neurological diseases, have a very low toleration for pressure when seated. A pressure, which to most persons is relatively insignificant, may become quite unbearable to certain persons, as for example, an individual who is partially paralyzed.

Besides the back and the thighs, a person's forearms may encounter undue stress due to relatively rigid arm rests on a chair. For example, a person suffering from Guillian Barre Syndrome may find the forearm pressure becoming quite unbearable, even for periods of short duration. Capability of diminishing tissue pressure would alleviate discomfort and prevent tissue breakdown and "bedsores".

Despite the isolated disclosures in the prior art, no one to date (to the best of my knowledge and belief) has developed a commercially-practical scientifically-designed chair that will alleviate undue stress on the person's back, thighs and/or forearms and superficial body tissues.

SUMMARY OF THE INVENTION

Accordingly, it is an object of the present invention, to alleviate the disadvantages and deficiencies of the prior art by providing a scientifically-designed office or den chair that will substantially eliminate the physical, psychological and emotional stress encountered, for example, by an executive who occupies the chair for extended periods of time.

It is another object of the present invention to provide a stress-reducing mechanism embodied within a chair or chair attachment in a scientifically-designed esthetically-attractive product, such as an executive-type office, hospital or den chair that is attractive and comfortable, yet may be easily mass-produced at relatively low-cost for substantially widespread marketing and distribution.

It is yet another object of the present invention to provide a chair that will readily accommodate the seating requirements of burn patients, stroke victims and others having a relatively low toleration for rigid pressure points on their back, thighs and/or forearms.

It is a further object of the present invention to provide removable cushions (filled with water or other medium) and in the form of convenient attachments that may easily retrofit the backs, seats and/or arm rests of an existing chair.

In accordance with the teachings of the present invention, there is herein illustrated and described, a fluid cushion assembly for the back of a chair. The assembly is integrally molded and includes a plurality of horizontally-disposed separate sections adapted to rest against the back of the chair forwardly thereof. Each of the sections is substantially oval in cross-section and has respective convex external portions joined directly to one another. Each of the sections includes a respective casing adapted to be filled with fluid (such as water); and valve means is associated with each of the casings, such that the level of water in each of the casings may be set at a predetermined level. Means are provided for releasably securing the assembly to the back of the chair.

Preferably, the back of the chair has a front surface and a back surface; and the front surface of the chair has a plurality of substantially horizontally-arranged scalloped recesses formed thereon, the scalloped recesses being complementary to the plurality of sections in the assembly. In a preferred embodiment, there are three scalloped recesses adapted to receive three respective sections of the assembly. Moreover, the back of the chair is provided with two sets of horizontally-spaced slots, one set at the upper portion of the scalloped recesses, and the other set at the lower portion of the scalloped recesses. The slots each extend from the front surface to the back surface of the back of the chair. The water cushion assembly has a top portion and a bottom portion and is provided with two pairs of horizontally-spaced straps, one pair at the top portion of the assembly, and the other pair of the bottom portion of the assembly. The straps are adapted to be received through the respective slots in the back of the chair, and each of the straps is provided with a quick-release fibrous fastener for removably securing the assembly to the back of the chair.

In accordance with the further teachings of the present invention, there is herein illustrated and described, a chair having a back member and further having a seat member extending forwardly therefrom. The back member includes a front surface and a rear surface, and further includes an upper portion. A substantially-cylindrical first bolster is secured to the upper portion of the back member. The front surface of the back member further has a plurality of substantially horizontally-arranged scalloped recesses formed thereon below the upper portion of the back member. A first cushion assembly is removably secured to the front surface of the back member below the first bolster. The first cushion assembly has a corresponding plurality of substantially horizontally-arranged vertically-spaced first sections complementary to the scalloped recesses in the front surface of the back member. Each of the first sections includes a casing for a liquid. The casings are spaced vertically from each other, and first valve means are associated with each of the casings for adding a desired amount of liquid to the casings. The seat member includes a top surface and further includes a forward portion, and a substantially-cylindrical second bolster is secured to the forward portion of the seat member. The top surface of the seat member has a plurality of substantially horizontally-arranged scalloped recesses formed thereon rearwardly of the forward portion of the seat member. A second cushion assembly is removably secured to the top surface of the seat member rearwardly of the second bolster. The second cushion assembly has a corresponding plurality of substantially horizontally-arranged second sections complementary to the scalloped recesses on the top surface of the seat member. Each of the second sections includes a respective casing for a liquid, and second valve means is associated with each of the respective casings. A substantially one-piece cover removably covers the back member and the seat member. The cover includes respective flap portions extending around the rear surface of the back member, and means are provided for removably joining the respective flap portions together.

Preferably, the respective casings may be slidably removed independently from the respective sections; the water may be heated to a desirable temperature, and a thermal barrier may be provided around the casings.

In accordance with the still further teachings of the present invention, there is further illustrated and described, a liquid or air cushion attachment for the back of a chair. The attachment includes a substantially one-piece sleeve member having a central opening therein, thereby adapting the sleeve member to slip over the back of the chair; and means are provided for removably securing the sleeve member to the back of the chair. An outer covering is further provided for the sleeve member. The sleeve member has a portion disposed forwardly of the front surface of the back of the chair, and the portion includes a plurality of casings therein. The casings are arranged substantially horizontally; and each of the casings is adapted to be filled with a liquid, such that the level of liquid in the respective casings may be different.

Preferably, the means for removably securing the sleeve member to the back of the chair includes a plurality of complementary straps provided with quick-release fibrous fasteners. Alternately, the means for removably securing the sleeve member to the back of the chair includes a rearwardly-disposed flap adapted to wrap over the back of the chair, and the flap has a quick-release fibrous fastener adapted to releasably engage a corresponding fastener on the back of the chair.

A liquid or air cushion attachment is also provided for the arm rest of a chair. This attachment comprises a substantially unitary member adapted to fit over and be complementary to the arm rest of a chair; and means are provided for filling the member to a predetermined amount. The member has a cover including respective side portions and further including a front flap. First means are provided for releasably securing the side portions to the chair, respectively, and second means are provided for releasably securing the front flap to the chair.

In yet another aspect, the present invention provides (in combination with a chair having a back portion, a seat portion, and respective arm rests) a first water cushion assembly secured to the back of the chair; a second water cushion assembly secured to the seat of the chair; and third water cushion assemblies secured to the respective arm rests of the chair.

These and other objects of the present invention will become apparent from a reading of the following specification, taken in conjunction with the enclosed drawings.

DESCRIPTION OF THE PREFERRED EMBODIMENTS

Figure 1:
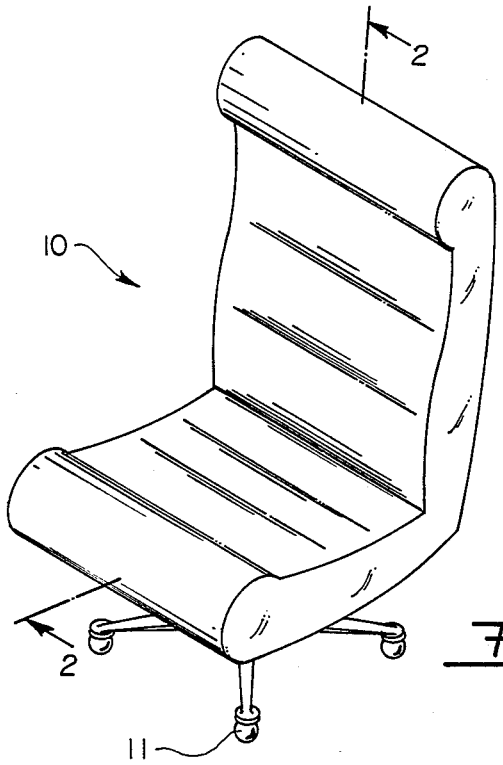
FIG. 1 is a front isometric or pictorial view of a chair constructed in accordance with the teachings of the present invention.

With reference to FIGS. 1-5, a chair 10 is illustrated with which the teachings of the present invention may find more particularly utility. It will be appreciated by those skilled in the art, however, that the teachings of the present invention are not confined to the particular chair 10 illustrated herein, but rather are equally applicable to a wide variety of chairs and seating devices. With this in mind, the chair 10 is provided with a conventional swivel base assembly 11. If desired, the chair may also be provided with suitable arm rests which, being conventional, have been omitted herein for ease of illustration.

The chair 10 includes a back member 12 and a seat member 13 extending forwardly therefrom. Preferably, the back member 12 and seat member 13 are substantially integrally formed, as shown more clearly in FIG. 3. The back member includes a front surface 14 and a rear surface 15, and further includes an upper portion 16. A substantially-cylindrical first bolster 17 is removably secured to the upper portion of the back of the chair (as hereinafter described).

The front surface of the back of the chair has a plurality of substantially horizontally-arranged scalloped recesses 18 formed thereon below the upper portion of the back member. Preferably, there are three scalloped recesses, as shown more clearly in FIG. 3; but it will be appreciated by those skilled in the art that any number of scalloped recesses may be provided, consonant with the teachings of the present invention.

A first cushion assembly 19 is removably secured to the front surface of the back member of the chair, below the upper portion thereof. This first cushion assembly 19 has a corresponding plurality of substantially horizontally-arranged vertically-spaced sections 20 complementary to the scalloped recesses in the front surface of the back of the chair. Each of the sections 20 has a respective pocket including an internal wall formed therein. Disposed in each pocket is; includes a casing 21 for a liquid which, preferably but not necessarily, is water. Each casing has an external wall which is shaped complementary to the internal wall of the pocket. The casings 21 are disposed in a respective pocket having the external wall radially contacting the internal wall of the pocket over substantially the entire length thereof. These casings 21 are further spaced vertically from one another. Formed thusly, when disposed in place, each section is received in a respective scalloped recess, being nested and supported therein.

Figure 2:
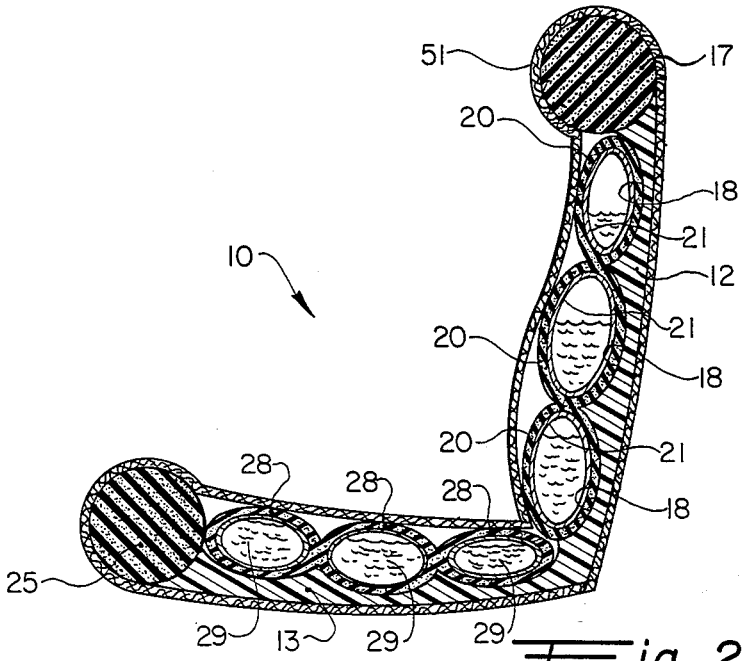
FIG. 2 is a longitudinal cross sectional view thereof, taken across the lines 2—2 of FIG. 1 (the individual straps for removably securing the major components of the chair having been omitted for ease of illustration).

As illustrated more clearly in FIG. 2, the sections 20 with their respective casings 21 are each preferably substantially oval in cross-section, and the sections have respective convex external portions joined directly to one another, between the respective casings, rather than being spaced from one another. Moreover, the casings within the respective sections are provided with respective valves 22, such that level of water in each of the casings may be set at a predetermined level. Thus, and again as shown more clearly in FIG. 2, the lowermost casing has the highest level of water, while the uppermost casing has the lowest level of water. With this arrangement, greater support will be provided for the lower (or lumbar) back region of the occupant. However, if desired, any arrangement of varying support may be accommodated, depending upon the particular requirements and desires of the occupant.

With reference again to FIGS. 2 and 3, the seat member 13 of the chair 10 includes a top surface 23 and further includes a forward portion 24. A substantially-cylindrical second bolster 25 is removably secured to the forward portion of the seat member. The top surface of the seat member has a plurality (preferably, but not necessarily, three) of substantially horizontally-arranged scalloped recesses 26 formed thereon, rearwardly of the forward portion of the seat member. A second cushion assembly 27 is removably secured to the top surface of the seat member, rearwardly of the second bolster.

This second cushion assembly 27, like the first cushion assembly 19, has a corresponding plurality (preferably three) of substantially horizontally-arranged second sections 28 complementary to the scalloped recesses 25 on the top surface of the seat member. Each of the sections 28 includes a respective casing 29 for water (or other liquid). Each of the casings 29 has a valve 30 associated therewith, so that the casings in the respective sections may be filled with water to a desired predetermined level.

Preferably, the major components of the chair—the first cushion assembly 19 for the back, the second cushion assembly 27 for the seat, and the bolsters 17 and 25, respectively—are assembled to the chair 10 by a plurality of straps. Thus, the first bolster 17 is provided with sets of straps 31 and 32 respectively. These straps 31 and 32 are received through the corresponding sets of slots 33 and 34, respectively, formed in the upper portion of the back of the chair. The end portions of the straps 31 and 32 are removably secured together by respective "VELCRO" quick-release fibrous fasteners (one of which is shown at 35) or other suitable means.

Likewise, the first cushion assembly 19 has sets of straps 36 and 37, respectively, for receipt through two sets of corresponding slots 38 and 39, respectively, formed in the back of the chair. The end portions of straps 36 and 37 are removably secured together by respective "VELCRO" quick-release fibrous fasteners (one of which is shown at 40) or other suitable means. Additionally, the second cushion assembly 27 has two sets of straps 41 and 42, respectively, for receipt through two sets of corresponding slots 43 and 44, respectively, formed in the seat portion of the chair. The end portions of straps 41 and 42 are removably secured together by "VELCRO" quick-release fibrous fasteners (one of which is shown at 45) or other suitable means. Finally, the second bolster 25 has two sets of straps 46 and 47, respectively, for receipt through two sets of corresponding slots 48 and 49, respectively, formed in the forward portion of the seat of the chair. The end portions of straps 46 and 47 are removably secured together by respective "VELCRO" quick-release fibrous fasteners (one of which is shown at 50) or other suitable means.

Figure 3:
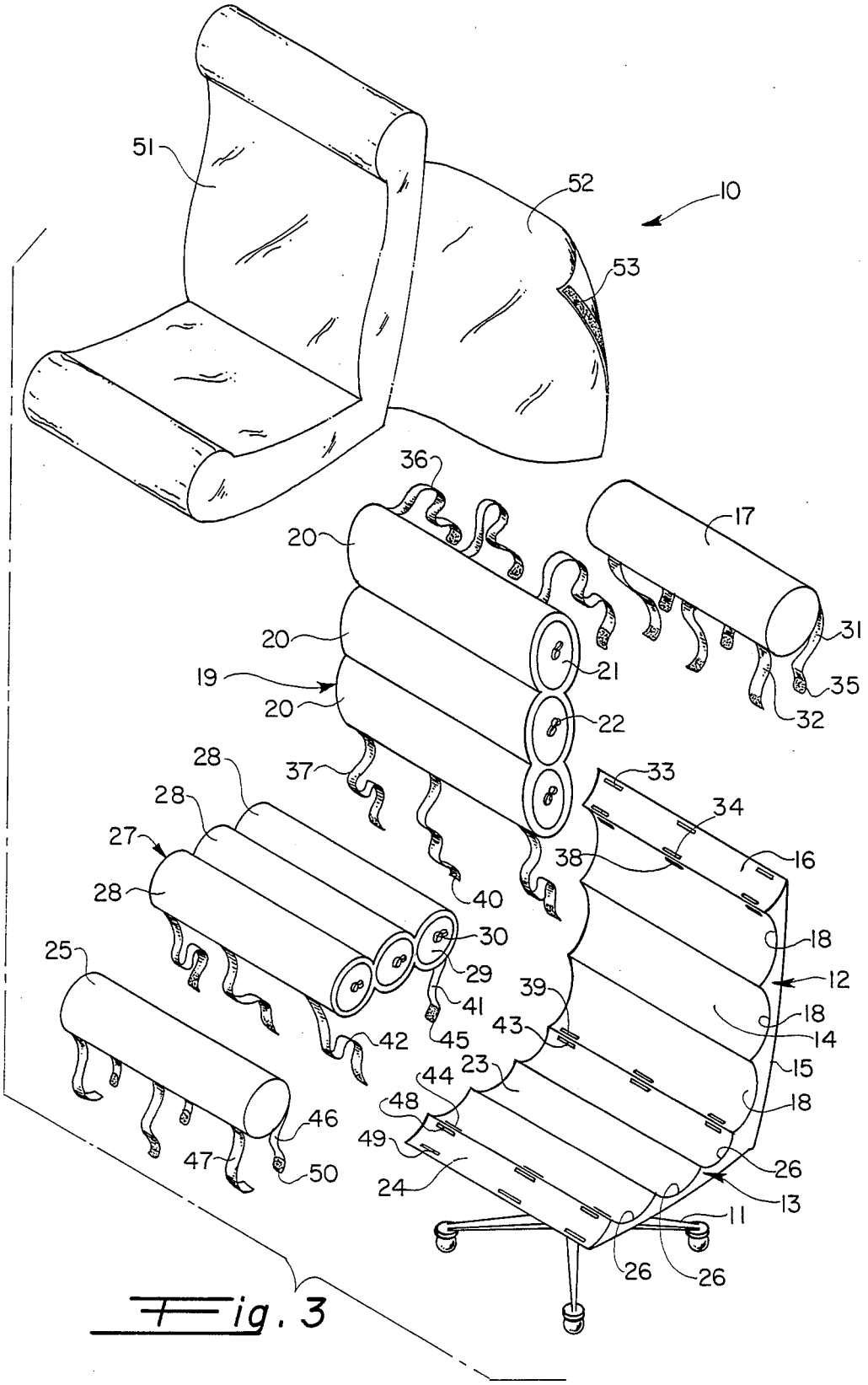
FIG. 3 is an exploded view of the chair of FIG. 1, showing the individual components thereof and the method of assembly into the finished chair.
Figure 4:
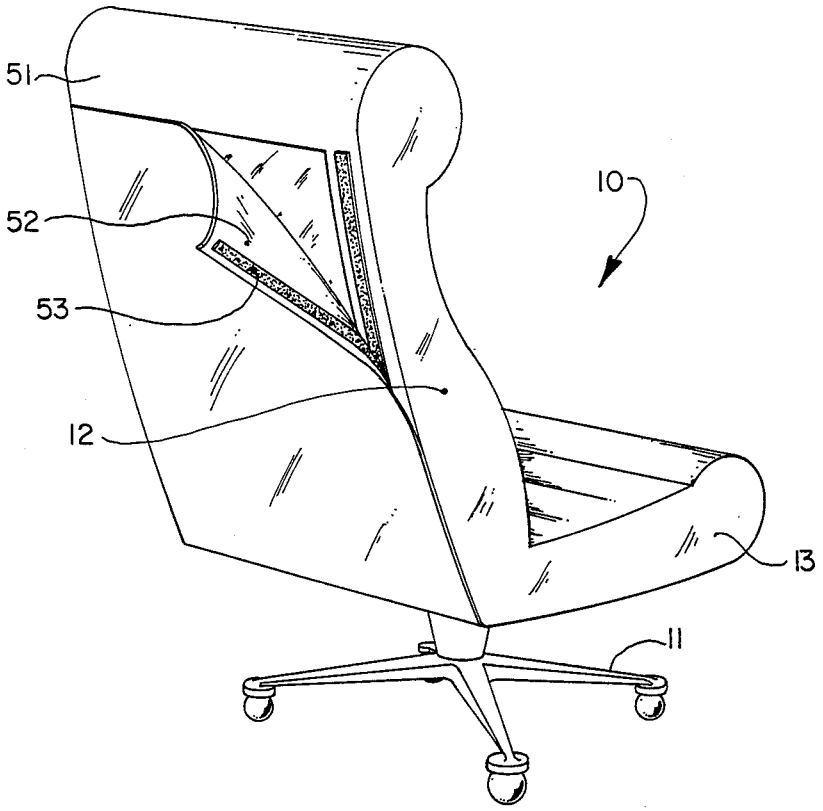
FIG. 4 is a rear isometric or pictorial view of the chair of FIG. 1, showing the back flap partially removed to illustrate its method of assembly.
Figure 5:
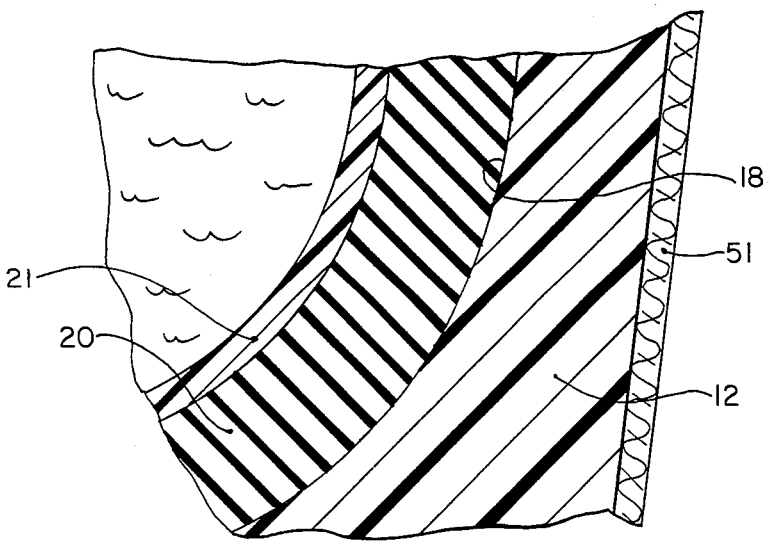
FIG. 5 is an enlarged portion of FIG. 2.

After the first and second bolsters 17 and 25, respectively, and the first and second cushion assemblies 19 and 27, respectively, are assembled to the back member 12 and seat member 13 of the chair 10, a substantially one-piece cover 51 is slipped over the assembled chair, as shown more clearly in FIG. 3. The cover may be made of any suitable material, such as fabric, plastic, leather or combinations thereof. The cover includes a flap portion 52 having a "VELCRO" quick-release fibrous fastener 53 cooperating with a corresponding fastener on the back of the chair. However, if desired, other suitable fastening means may be employed.

With reference to FIGS. 6–10, an alternate embodiment is illustrated, wherein an attachment in the form of a sleeve member 54 has a central opening 55 therein and is adapted to slip over the back of the chair 10'. The chair 10' has a central core 56 provided with a cover 57 of fabric or other suitable material. The sleeve member 54 has a backing portion 58 provided with respective horizontally-arranged scalloped recesses 59 for supporting respective sections 60. Each of the sections 60 has a casing 61, and each of the casings has suitable valve means (not shown, but substantially the same as the valves 22 or 30 for the embodiment of FIGS. 1–5) for filling the casings 61 with water (or other suitable liquid) to a predetermined level, as shown more clearly in FIG. 8.

Figure 6:
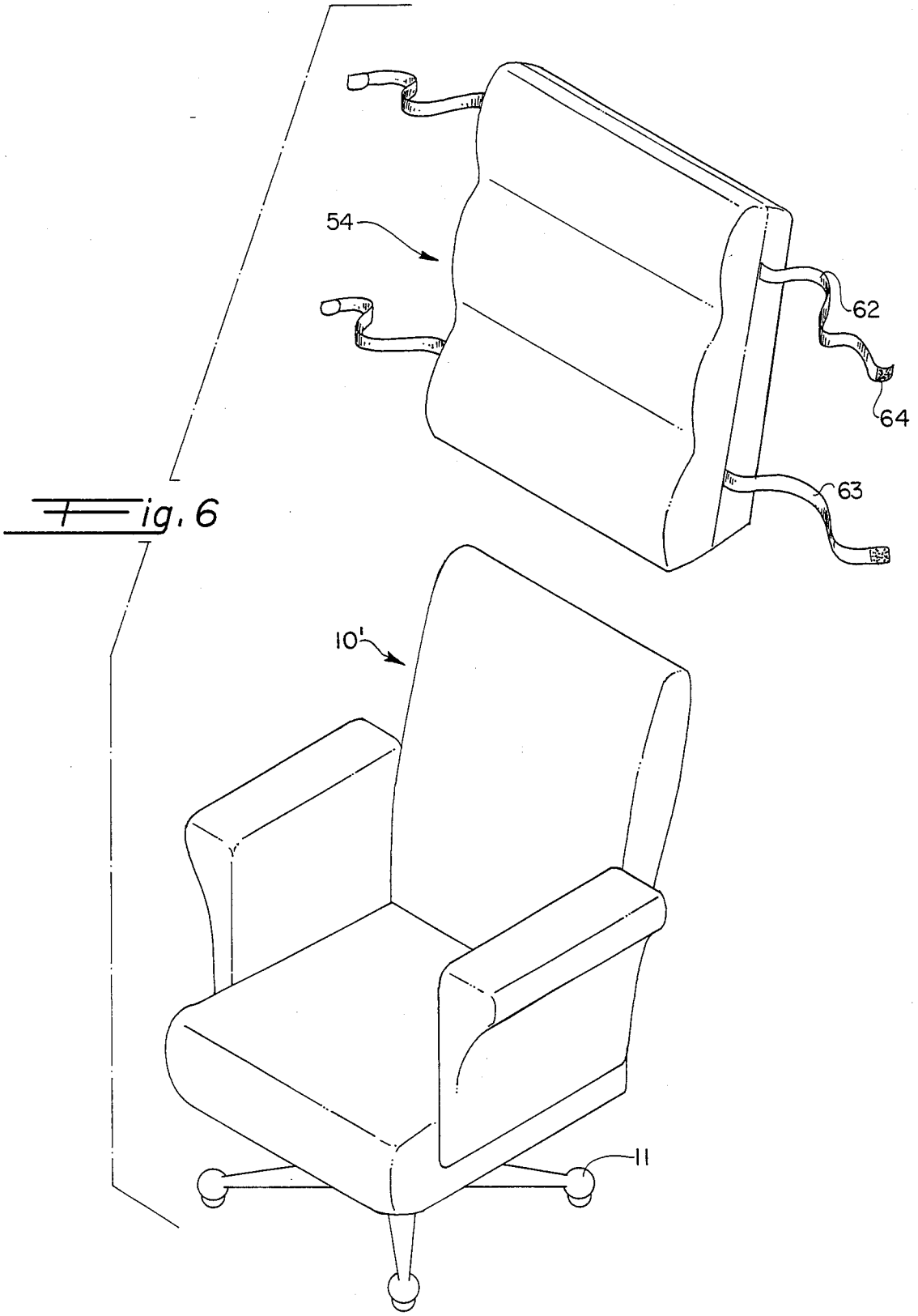
FIG. 6 is an exploded pictorial view of an alternate embodiment, showing a water cushion attachment formed as a substantially one-piece sleeve member adapted to slip over the back of a chair.
Figure 7:
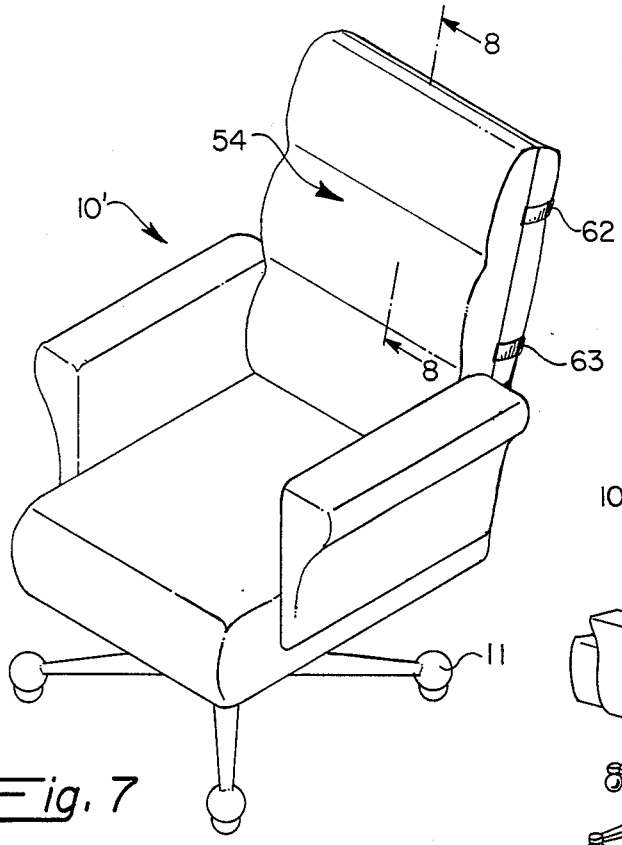
FIG. 7 is a front isometric or pictorial view of the chair of FIG. 6 with the water cushion attachment assembled on the chair.
Figure 10:
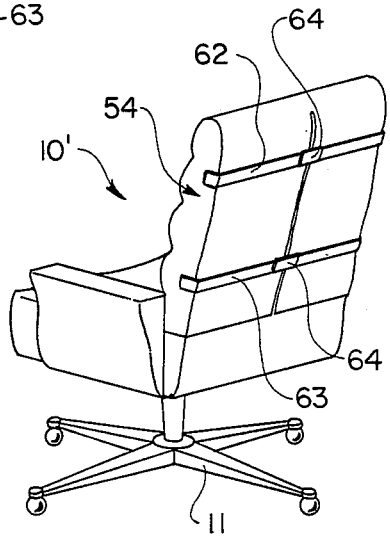
FIG. 10 is a rear isometric or pictorial view of the chair of FIG. 7, drawn to a reduced scale, and showing the removable securing of the straps on the water cushion attachment.
Figure 8:
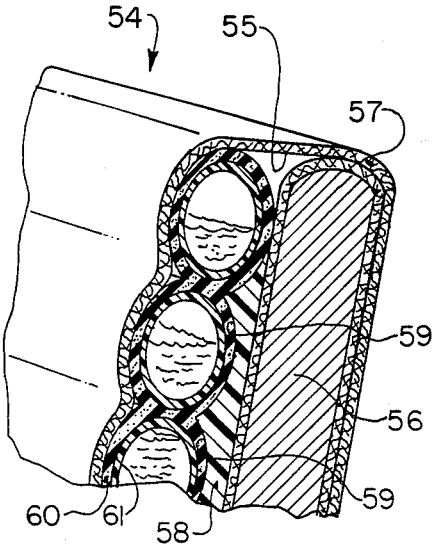
FIG. 8 is a partial longitudinal cross-sectional view thereof, taken along the lines 8—8 of FIG. 7, and drawn to an enlarged scale.

The sleeve member 54, as shown more clearly in FIGS. 6 and 10, may be provided with a plurality of straps 62 and 63 having respective "VELCRO" quick-release fibrous fasteners 64 (or other suitable means) for removably securing the straps 62 and 63 together, thereby removably attaching the sleeve member to the chair.

Figure 9:
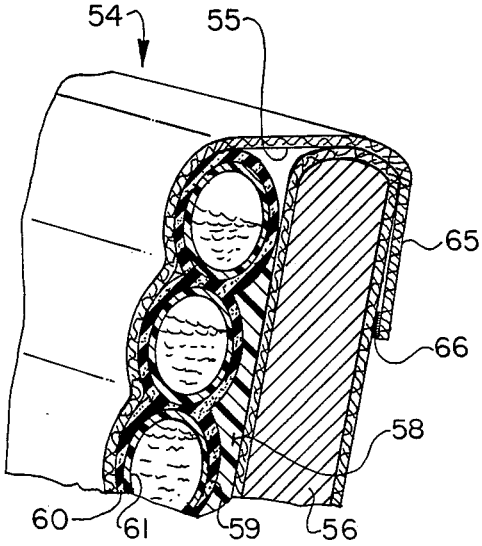
FIG. 9 is a further cross-sectional view, corresponding substantially to FIG. 8, but illustrating an alternate method of removably securing the attachment to the back of the chair.

With reference to FIG. 9, in lieu of the straps 62 and 63 and fasteners 64, respectively, the cover of the sleeve member may include an integral flap portion 65 that flips over the back of the chair and is removably attached thereto, again, by a "VELCRO" fibrous fastener 66 (or other suitable means).

Figure 11:
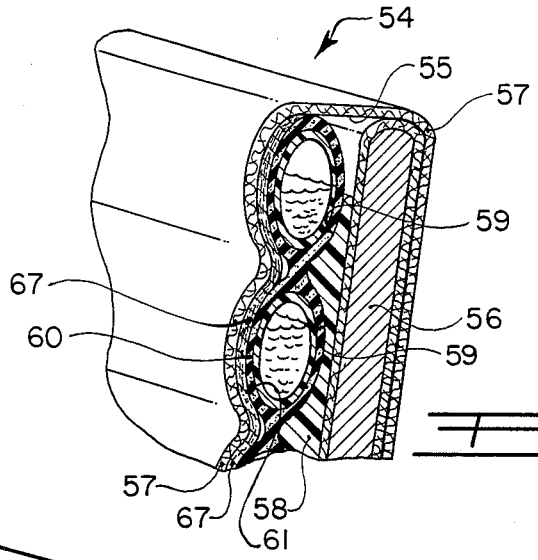
FIG. 11 is a still further cross-sectional view, corresponding substantially to FIG. 8, but illustrating a thermal barrier between the water cushion and the occupant.

With reference to FIG. 11, a thermal barrier 67 has been inserted between the cover 57 and the sections 60. This thermal barrier may consist of a layer of fiberglass material, for example, and is intended to prevent the occupant of the chair from encountering any undue chill from the water in the casings in the respective sections, especially during winter months when the office has not been occupied during the weekend and the heat has been turned off.

Figure 12:
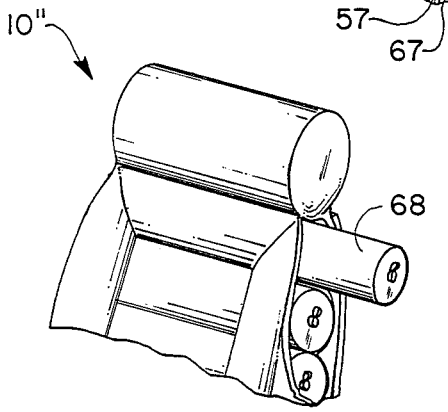
FIG. 12 is a fragmentary pictorial view of the top portion of the back of a chair, with parts broken away to illustrate a casing being slidably removed from the water cushion assembly.

With reference to FIG. 12, the chair 10'' has a casing 68 that may be removed conveniently for filling purposes.

Figure 13:
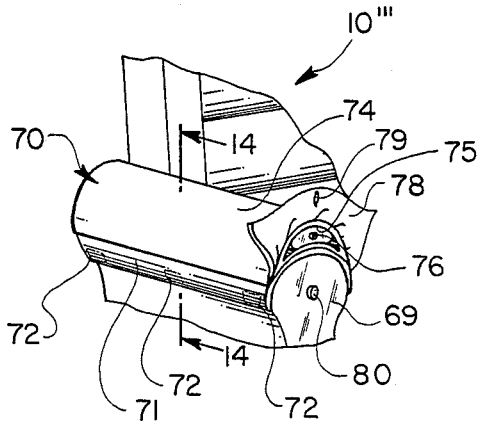
FIG. 13 is a fragmentary pictorial view of a cushion assembly for the arm rest of a chair, showing the attachment thereto.
Figure 14:
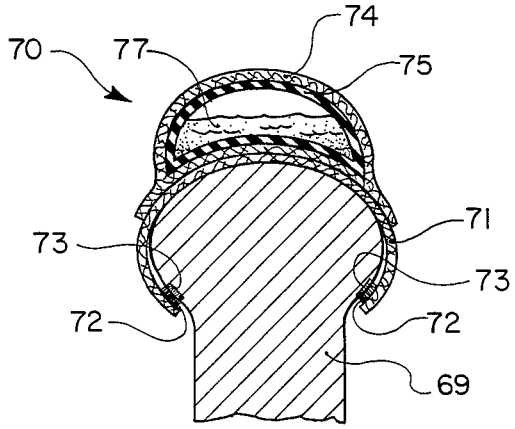
FIG. 14 is a cross-sectional view, taken across the lines 13—13 of FIG. 12.

With reference to FIGS. 13 and 14, the arm rests of a chair 10''' (one of which is shown at 69) is provided with a water cushion assembly 70. This assembly 70 includes a bottom support 71 which is curved to closely approximate the contour of the arm rest 69 and to be complementary thereto. The bottom support 71 has side portions provided with "VELCRO" fibrous fasteners 72 for cooperation with "VELCRO" fibrous fasteners 73 on the arm rest of the chair, thereby removably attaching the water cushion assembly to the arm rest of the chair. It will be appreciated, however, that other methods of assembly may be employed, consonant with the teachings of the present invention. The bottom support is integrally joined to an upper support 74 having a casing 75 formed therein. The casing 75 has a valve 76 for filling the casing with water 77 (or other liquid or other medium) to a desired level.

As shown more clearly in FIG. 13, the upper support has a flexible front flap 78 for providing access to the valve in the casing. The flap has a button hole 79 for cooperation with a button 80 mounted on the arm rest of the chair, thereby providing a "snap" fit therebetween.

As a result, the present invention provides commercially-practical scientifically-designed attractive water cushion assemblies for a chair, intended to relieve the psychological and emotional stress associated with back pains due to improper posture and support, as well as accommodating the special needs of burn victims, stroke patients and the like.

Obviously, many modifications may be made without departing from the basic spirit of the present invention. For example, the respective cushion assemblies may be filled with any suitable liquid, such as water, and may be filled with air or a suitable gas intended to provide the desired degree of relative stiffness or resiliency. Accordingly, it will be appreciated by those skilled in the art that within the scope of the appended claims, the invention may be practiced other than has been specifically described herein.

What is claimed is:

1. A fluid cushion assembly for the back of a chair, comprising an integrally molded assembly having a plurality of horizontally-disposed separate sections adapted to rest against the back of the chair forwardly thereof, each of the sections being substantially oval in cross-section and having respective convex external portions joined directly to one another, each of the sections including a respective casing adapted to be filled with fluid, valve means associated with each of the casings, whereby the level of fluid in each of the casings may be set at a predetermined level, and means for releasably securing the assembly to the back of the chair;

wherein the fluid is water;

the back of the chair including a front surface and a back surface, the front surface having a plurality of substantially horizontally-arranged scalloped recesses formed thereon, the scalloped recesses being complementary to the plurality of the sections in the assembly;

wherein three scalloped recesses are adapted to receive three respective sections of the assembly;

wherein the scalloped recesses further having an upper portion and a lower portion in the back of the chair, wherein the back of the chair is provided with two sets of horizontally-spaced slots, one set at the upper portion of the scalloped recesses, the other set at the lower portion of the scalloped recesses, the slots each extending from the front surface to the back surface of the back of the chair, and wherein the fluid cushion assembly has a top portion and a bottom portion and is provided with two pairs of horizontally-spaced straps, one pair at the top portion of the assembly, and the other pair of the bottom portion of the assembly, the straps being adapted to be received through the respective slots in the back of the chair, and each of the straps being provided with a quick release fibrous fastener for removably securing the assembly to the back of the chair.

2. A chair, comprising a back member and a seat member extending forwardly therefrom, the back member including a front surface and a rear surface, the back member further including an upper portion, a substantially-cylindrical first bolster secured to the upper portion of the back member, the front surface of the back member having a plurality of substantially horizontally-arranged scalloped recesses formed thereon below the upper portion of the back member, a first cushion assembly removably secured to the front surface of the back member below the first bolster, the first cushion assembly having a corresponding plurality of substantially horizontally-arranged vertically-spaced first sections complementary to the scalloped recesses in the front surface of the back member, wherein, each section is received, nested and supported in a respective recess of the assemblies, each of the first sections including a casing for a liquid, the casings being spaced vertically from each other, first valve means associated with each of the casings for adding a desired amount of liquid to the casings, the seat member including a top surface and further including a forward portion, a substantially-cylindrical second bolster secured to the forward portion of the seat member, the top surface of the seat member having a plurality of substantially horizontally-arranged scalloped recesses formed thereon rearwardly of the forward portion of the seat member, a second cushion assembly removably secured to the top surface of the seat member rearwardly of the second bolster, the second cushion assembly having a corresponding plurality of substantially horizontally-arranged second sections complementary to the scalloped recesses on the top surface of the seat member, wherein each section is received, nested and supported in a respective recess of the assemblies, each of the second sections including a respective casing for a liquid, second valve means associated with each of the respective casings for adding a desired amount of liquid to the respective casings, a substantially one-piece cover removably covering the back member and the seat member, the cover including respective flap portions extending around the rear surface of the back member, and means for removably joining the respective flap portions together.

3. The chair of claim 2, wherein the respective casings may be slidably removed independently from the respective sections.

4. The chair of claim 2, wherein the liquid may be heated to a desirable temperature, and wherein a thermal barrier is provided around the casings.

* * * * *